United States Patent [19]

Moore

[11] Patent Number: 4,577,670

[45] Date of Patent: Mar. 25, 1986

[54] VACUUM CONTROL SYSTEM FOR CASTING MACHINE DIES

[75] Inventor: James I. Moore, Zeeland, Mich.

[73] Assignee: Ex-Cell-O Corporation, Troy, Mich.

[21] Appl. No.: 632,352

[22] Filed: Jul. 19, 1984

[51] Int. Cl.[4] ..... B22D 17/14

[52] U.S. Cl. ..... 164/155; 164/253; 164/305

[58] Field of Search ..... 164/305, 61, 63, 65, 164/254, 253, 154, 155, 457

[56] References Cited

U.S. PATENT DOCUMENTS

| | | | |
|---|---|---|---|
| 2,785,448 | 3/1957 | Hodler | 164/254 X |
| 3,349,833 | 10/1967 | Hodler | 164/305 X |
| 3,745,828 | 7/1973 | Howell | 164/154 X |
| 4,431,047 | 2/1984 | Takeshima et al. | 164/253 |
| 4,463,793 | 8/1984 | Thurner | 164/155 |

*Primary Examiner*—Nicholas P. Godici
*Assistant Examiner*—K. Berg
*Attorney, Agent, or Firm*—John C. Evans

[57] ABSTRACT

A casting machine die evacuation system has a vacuum source for evacuating the die cavity during casting connected to a chill block vent passage through a vacuum cut-off plug driven by a high pressure hydraulic system into an evacuation position at the start of casting and into a vacuum cut-off position in response to fast shot plunger operation. The tip of the plug is held in contact with the chill block so that cast material flow into the chill block vent passage will flow around the diameter of the plug without acting to unseat the plug from its vacuum cut-off position.

2 Claims, 3 Drawing Figures

VACUUM CONTROL SYSTEM FOR CASTING MACHINE DIES

TECHNICAL FIELD

This invention pertains to casting machines and more particularly to vacuum control systems for evacuating a die cavity.

BACKGROUND ART

In order to assure high quality castings, die cavities are evacuated prior to flow of molten material into the cavity. Prior systems include a vacuum device which is coupled through a vacuum supply system including conduits, filters and cut-off valves to the die cavity. In such systems, mechanical control means detect closure of a pour hole in the molten material transfer system to control the vacuum valves so as to communicate the die cavity with the vacuum device. The die cavity is evacuated. At fast shot the vacuum valve is closed to disconnect the vacuum system from the die cavity. Such cut-off valves, when closed, have the molten material pressures imposed thereon and high casting pressures can cause the vacuum valves to be plugged up.

STATEMENT OF INVENTION AND ADVANTAGES

In accordance with the present invention, a chill block assembly includes a hydraulically operated plug which is arranged to control vacuum flow through the chill block vent passages to evacuate the die cavity. The plug is located in a bore formed in one half of the chill block and is operated so that its end face engages the opposite half of the chill block when the vacuum system is closed. Material flow through the chill block will encircle the plug to stabilize it and prevent plug opening by pressure spikes or excessive casting pressures.

Consequently, during molten material passage into the die cavity, the vacuum system remains isolated from the die cavity. Further, prior problems of valve plug-up or valve opening with resultant fouling of the vacuum system components are eliminated.

The hydraulic operator for the plug is controlled by output signals from the machine controller. The signals condition a solenoid valve to communicate a hydraulic pressure accumulator with a hydraulic drive cylinder that produces high speed direct actuation of the plug in response to the position of the shot cylinder plunger. The vacuum system is initially closed. A machine controller produces a pour opening signal to condition the hydraulic operator to unseat the plug from the chill block closure position and position it in an evacuation position which communicates the chill block vent passage and die cavity with an evacuated vacuum receiver tank held at a pressure of twenty-eight inches of water. The die cavity is evacuated to the receiver tank prior to the start of fast shot. At the fast shot a second signal is directed to the hydraulic operator to reverse the hydraulic drive cylinder to rapidly drive the plug into its chill block closure position so that molten material flow through the chill block will not enter the vacuum system.

Other advantages and a more complete understanding of the invention will be apparent to those skilled in the art from the succeeding detailed description of the invention and the accompanying drawings thereof.

DESCRIPTION OF THE INVENTION

Figure 1:
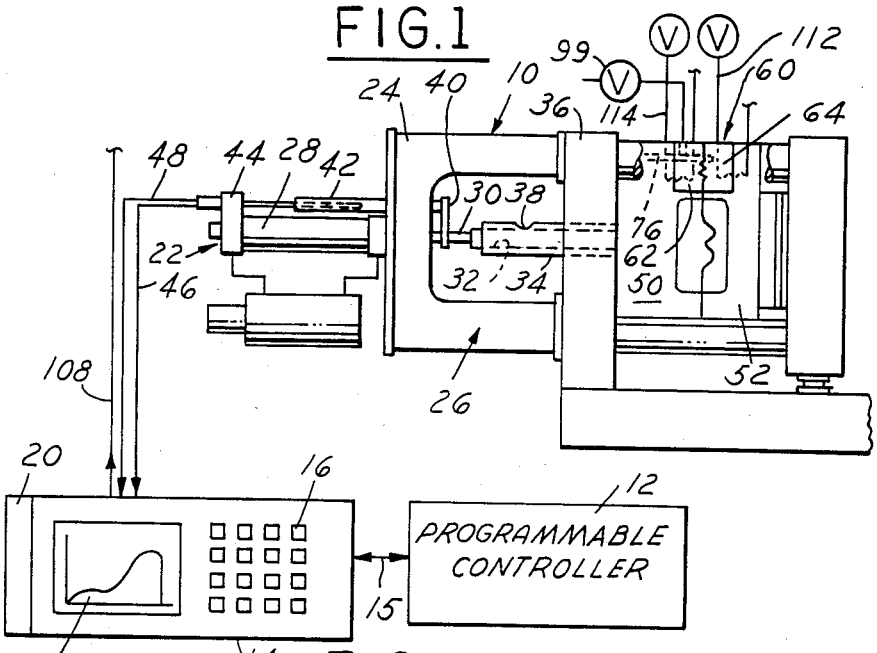
FIG. 1 is a diagrammatic view of a casting machine including the present invention.
Figure 3:
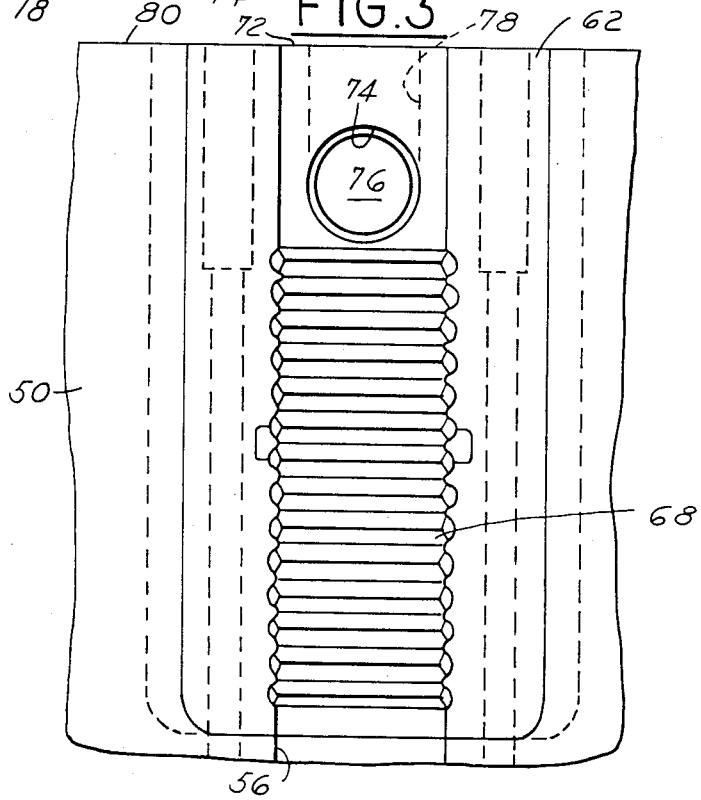
FIG. 3 is a side elevational view of a chill block half.

Referring now to FIG. 1, a casting machine 10 is controlled by a programmable controller 12. Microprocessor 14 communicates with the programmable controller through a data bus 15. The micro-processor 12 can be a known input/output (I/0) digital computer which, in turn, communicates with the I/0 terminals of the programmable machine controller. The operator communicates with the microprocessor and the programmable controller by a keyboard 16. All of this can be displayed on a CRT 18 which will direct the operator to answer the proper communications for each job. Once these questions are answered and the job is running, this information is stored either on a floppy disk memory 20 or in a central computer for future use. The die casting machine 10 is of the type more specifically set forth in U.S. Pat. No. 4,064,928 issued Dec. 27, 1977 to Wunder for Die Casting Machine.

The machine 10 includes a shot assembly 22 mounted on a vertical face plate 24 of a C-frame bracket 26. The shot assembly includes a hydraulically operated shot cylinder 28 that drives a reciprocable output plunger 30 which reciprocates in a shot chamber 32 (usually referred to as a "cold chamber" in a cylinder or sleeve 34 mounted on a front plate 36 of the machine. Molten metal such as aluminum is poured into a pour opening 38 of the cold chamber and the plunger is reciprocated to force the liquid metal into a die cavity.

A carriage 40 connected to plunger 30 drives a movable position indicating tube 42 with respect to a linear displacement transducer 44 which produces a DC output signal on line 46 indicating the position of the ram 30 and a DC output signal on line 48 indicating the velocity of ram 30 during programmed operation of the machine. The velocity signal is directed to a pilot valve amplifier circuit for closed loop velocity control of the machine. The position signal is directed to an analog input module of the programmable controller 12. The programmable controller 12 is more specifically set forth in our co-pending U.S. Ser. No. 331,350, filed Dec. 16, 1981 for Shot Cylinder Control which is incorporated herein by reference. Controller 12 controls the shot cylinder speed to compensate for changes in the temperature of hydraulic fluid in the machine and other operating variables which can affect the finished casting.

The memory of the programmable controller 12 is set by thumb-wheel switches pre-setting desired slow shot velocity, fast shot velocity, low impact velocity and follow through velocity, respectively. The controller 12 can also control machine functions such as start-up and the like. The velocity control switches are used to preset shoot speed values into the memory of controller 12. Additional pre-settable memory is established by position control thumb-wheel switches for setting shot retracted position, fast shot position, low impact position and start intensifier position.

The microprocessor 14 can be one of several microprocessors on the market that communicate with people in basic language and which require very little training in their use. The processor would have a real-time multi-task unit which provides simultaneous execution of multiple, independent tasks with fast, efficient task development. Such systems enable the execution in the order of 20 independent tasks simultaneously. These tasks operate independently of each other, may be assigned priorities as required, or can be suspended for a specified time.

Figure 2:
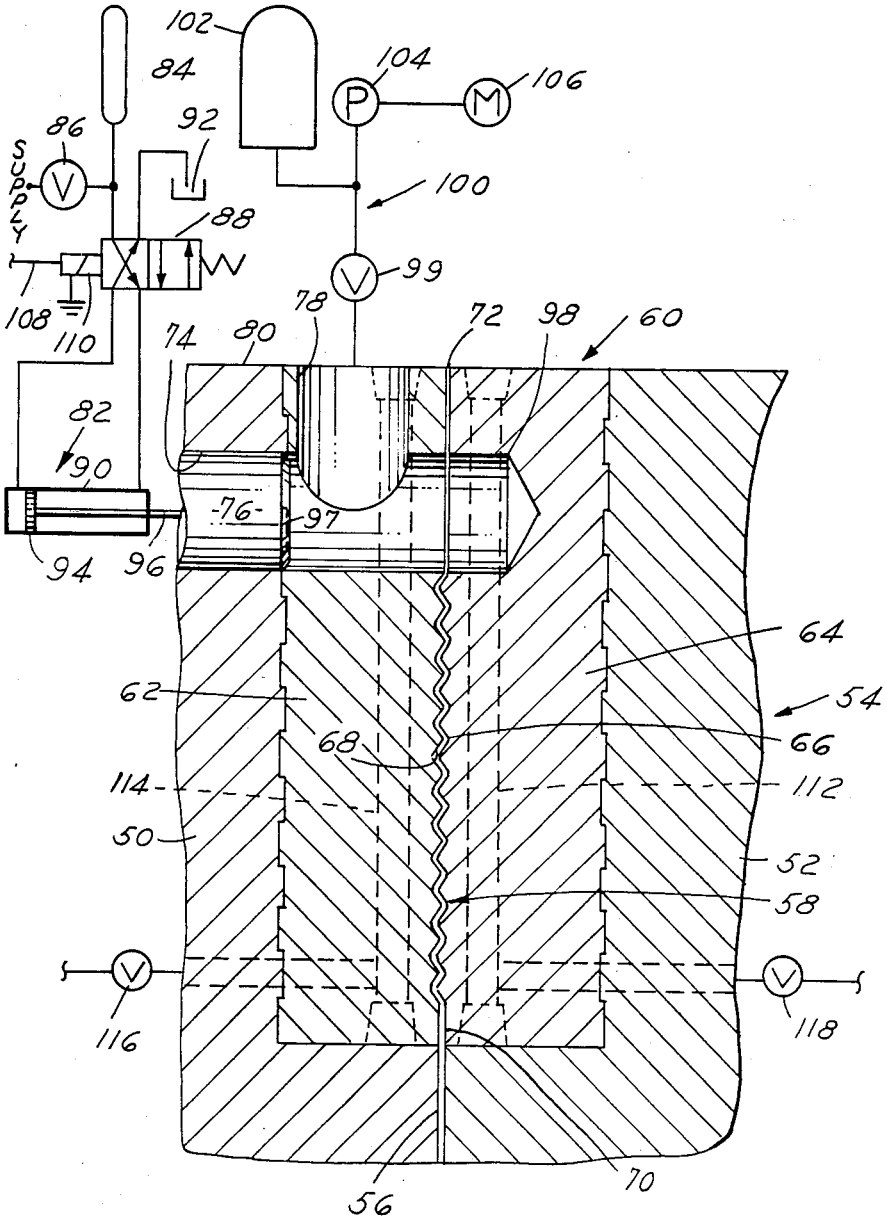
FIG. 2 is a diagrammatic view of die ejector and cover halves in association with the chill block and vacuum control system of the invention.

As best shown in FIG. 2, the machine 10 includes an ejector half 50 and a cover half 52 of a casting die assembly 54 defining a die cavity. The die cavity has an outlet passage 56 in communication with a vent passage 58 in a chill block assembly 60 having an ejector side 62 and a cover side 64. The cover side 64 has a plurality of spaced convolutions or waffles 66 that have their peaks spaced in a tapered relationship to a facing surface 68 on ejector side 62. The vent passage inlet 70 has a flow area approximately two times the flow area at its outlet 72 and the flow area is tapered therebetween. The flow passage area is selected to cause the die cavity to be evacuated in the time period in which the evacuation system is turned on and off.

The ejector side 62 has a bore 74 formed transversely through its outboard end. A plug 76 is reciprocally supported in the bore 74 to open and close a vacuum port 78 in the end face 80 of ejector side 62.

The plug 76 is operated by a high speed performance hydraulic actuator system 82. The system 82 includes a pressure accumulator 84 connected to the hydraulic supply of the machine through a pressure reducer valve 86. The pressure of accumulator 84 is under the control of a quick response solenoid valve 88 to direct the pressure to either side of a hydraulic cylinder 90 while dumping the opposite side to a sump 92.

The cylinder 94 has a drive piston 94 connected to a piston rod 96 which is connected to the plug 76 to position it in two control positions. One position is a vacuum-on position in which the vacuum port 78 is uncovered to communicate with vent passage 70. The other position is a vacuum-off position in which the plug 76 blocks port 78 and is positioned across the passage 70 with an end face 97 of the plug 76 in flush engagement with a seat surface 98 on cover side 64.

The vacuum port 78 is connected through a cut-off valve 99 to a vacuum system 100 including a vacuum receiver tank 102 and a vacuum pump 104 driven by a motor 106.

The operation of the vacuum system 100 includes a pump-down phase in which valve 98 is closed and the motor 106 drives vacuum pump 104 to evacuated receiver tank 102. During this phase a previously cast part can be removed from the machine.

At the start of the next casting operation, the solenoid valve 88 is de-energized to be shifted to the left as viewed in FIG. 2 and plug 76 is located in its vacuum-off position by extension of piston rod 96.

When the die casting plunger is positioned to close the pour opening 38, controller 12 produces a signal on line 108 to energize the solenoid valve armature 110 to shift the valve to the right as shown in FIG. 2. The hydraulic pressure in pressure accumulator 84 is directed to the right side of piston 94 to retract piston rod 96 to produce a high speed shift of plug 76 to its vacuum open position. The die cavity immediately is evacuated to receiver tank 102 whose volume is sufficient to accommodate air volume of the die cavity.

At the fast cycle of machine operation the controller 12 produces a signal on line 108 to de-energize solenoid valve 88 which rapidly shifts to cause the hydraulic cylinder 90 to extend piston rod 96 to position the plug 76 in its vacuum-closed position before molten material flow through the vent passage 58. The plug 76 remains positioned across the passage 58 and its end face 97 is held tight and flush to seat surface 96. Molten material which enters vent passage 58 will flow around the O.D. of the plug 76 and will not impose any opening force on the seated end of plug 76. Consequently the plug 76 remains closed to block the vacuum port 78 until the cast part is removed.

The drill block assembly 60 has cooling passages 112,114 connected through known cooling fluid control valves 116,118. Further, the chill block assembly 60 is constructed of a material with high thermal conductivity so as to assure that the molten material at the outlet 72 of vent passage 58 will not penetrate any clearance that might exist at the end face 97 or between bore 74 and plug 76 when in its vacuum-off position.

The aforesaid plug arrangement enables the cast parts to be removed by known ejector pins to separate the die halves and chill block halves. During ejection of a part the plug 76 will be removed from the surrounding chilled material so as to be re-positioned for a subsequent machine operation cycle.

The embodiments of the invention in which an exclusive property or privilege is claimed are defined as follows:

1.) A cavity evacuation system for a casting machine having die halves defining a casting cavity with a vent opening therein comprising:

vacuum system means with a receiver for accommodating the air volume of the casting cavity;

means defining a chill block assembly having first and second halves forming a vent passage for venting molten material from the cavity when the cavity is filled with casting material;

means including a reciprocating plug with a vacuum-on position and a vacuum-off position for controlling communication between said receiver and the casting cavity; said plug being positioned in its vacuum-on position to cause evacuation of the casting cavity through said vent passage; said reciprocating plug having an O.D. segment extending across said vent passage and having an end face thereon in sealing engagement with one of said halves when in its vacuum-off position to cause vented molten material to encircle the O.D. of the plug in the vent passage without imposing molten material pressure forces on said end face so as to block communication between said receiver and said vent passage during the casting process.

2.) An evacuation system for a die casting machine having separable die halves held closed to define a die cavity supplied from a shot cylinder with a plunger and a pour opening and with a chill block in communication therewith having first and second block halves defining a vent passage for excess casting material comprising:

a vacuum system including a receiver sized to accommodate the air volume of the die cavity;

said vent passage having a flow area to accommodate evacuation of the die cavity during an evacuation cycle;

means defining an open-ended bore formed transversely through one of said chill block halves;a vacuum port in said one of said halves in communication with said bore intermediate the open ends thereof;

a plug reciprocally mounted in said open-ended bore and having an O.D. portion and an end face engageable in flush relationship with a surface of the chill block;

control means for producing a pour opening plunger position signal and a fast shot signal;

hydraulically operated power means responsive to said pour opening position signal during casting to shift said plug into a vacuum-on position to open said vacuum port whereby air is evacuated from the die cavity through the vent passage before molten material enters the die cavity;

said hydraulically operated power means being responsive to said fast shot signal to position said plug in a vacuum-off position in which its O.D. portion bridges the vent passage and its end face engages the chill block to cause the vented material to encircle the O.D. portion of the plug without imposing material pressure forces on said end face so as to block communication between said vacuum port and said vent passage.

* * * * *